United States Patent [19]

Newth et al.

[11] Patent Number: 4,944,747

[45] Date of Patent: Jul. 31, 1990

[54] PAIN THERAPY TOOL AND METHOD

[76] Inventors: Gregory L. Newth; Alice C. S. Newth, both of 59 East Taylor Hill Rd., Montague, Mass. 01351

[21] Appl. No.: 303,992

[22] Filed: Jan. 27, 1989

Related U.S. Application Data

[63] Continuation of Ser. No. 105,313, Oct. 5, 1987, abandoned.

[51] Int. Cl.[5] ..... A61H 39/04

[52] U.S. Cl. ..... 606/204; 128/60

[58] Field of Search ..... 128/303 R, 329 A, 67, 128/60, 62 R; 15/222; 606/204, 189

[56] References Cited

U.S. PATENT DOCUMENTS

| | | | |
|---|---|---|---|
| 1,864,379 | 6/1932 | Tailor | 15/222 |
| 4,493,315 | 1/1985 | Iwahashi | 128/67 |
| 4,574,788 | 3/1986 | Jordan | 128/67 |
| 4,632,095 | 12/1986 | Libin | 128/60 |

FOREIGN PATENT DOCUMENTS

| | | | |
|---|---|---|---|
| 17056 | 12/1898 | Austria | 15/222 |
| 2019220 | 10/1979 | United Kingdom | 128/67 |

*Primary Examiner*—Michael H. Thaler

*Attorney, Agent, or Firm*—Fishman, Dionne & Cantor

[57] ABSTRACT

A hand operated tool for deactivating or detriggering pain or trigger points in the body is presented. This tool comprises a slightly curved elongated handle which terminates in a flattened section. The flattened section includes a round protrusion extending perpendicular therefrom and an eye hook at the tip thereof. A flexible strap is provided through the eye hook.

12 Claims, 4 Drawing Sheets

PAIN THERAPY TOOL AND METHOD

This is a continuation of co-pending application Ser. No. 105,313 filed on Oct. 5, 1987 abandoned.

BACKGROUND OF THE INVENTION

This invention relates to a hand actuated tool for providing pain therapy to the body. More particularly, this invention relates to a hand operated tool which is used to deactivate or detrigger pain points in the body. This invention is particularly well suited for use in Myotherapy techniques.

It is well known that "trigger points" are pain points in the body that many medical therapies try to relieve or deactivate. One such well known therapy is known as Myotherapy and is described in detail in the book "Pain Erasure" by Bonnie Prudden. Myotherapy techniques call for pressure to be exerted onto certain trigger or pain points in the body to thereby deactivate or detrigger said trigger or pain points, followed by performance of specific exercises. As a result, pain may be relieved without the use of foreign drugs. In the case of Myotherapy, the pressure exerted to detrigger the trigger points is accomplished by a myotherapist using a part of his or her body (e.g. fingers, knuckles, elbows, etc.) to exert pressure on a trigger point. Of course, such therapy necessitates that a second person be available to act as the myotherapist in exerting the necessary pressure. This is a significant drawback of Myotherapy and other trigger point type pain therapies because a second person (e.g., therapist) may not be available when pain therapy is needed. Still another problem with carrying out pressure point therapy on oneself is trying to simulate the accuracy, pressure, angles and location that a trained therapist can achieve.

In view of the foregoing, there is a need to improve the manner in which pain therapy such as Myotherapy can be performed when one needs to do it to oneself. Moreover, there is also a need for improving the manner in which an individual can simulate a therapist detriggering trigger points during the pain therapy.

SUMMARY OF THE INVENTION

The above-discussed and other drawbacks and deficiencies of the prior art are overcome or alleviated by the pain therapy tool of the present invention. In accordance with the present invention, a hand actuated tool is provided for use in deactivating or detriggering trigger points in the body for the relief of pain.

The hand tool of the present invention comprises a slightly curved elongated handle which terminates in a flattened section. The flattened section includes a rounded protrusion extending perpendicular therefrom and an eye hook at the tip thereof. A flexible strap is provided through the eye hook to thereby provide a flexible connection to the hand tool. During use, the handle is gripped by the person needing pain relief and the protrusion is positioned over the desired trigger point. Next, the strap is held taut in the persons other hand, wrapped across the body to create added friction, pulled tight and held stationary. At this point, the handle (which acts as a lever) is pulled down so that the pivotal connection between the handle and strap acts as a fulcrum forcing the protrusion into the body thereby exerting pressure at the intended trigger point. In different spots the handle and strap may reverse functions and the same process is carried out.

The pain therapy tool of the present invention provides many features and advantages not found in the prior art. For example, the present invention permits pain therapy (e.g., the deactivation or detriggering of trigger points in the body) to be practiced solely by the person suffering from the pain without the necessity of a second person acting as the therapist. Also, by using a strap of sufficient length, the hand tool may be used on any area of the body including hard to reach portions of the back. Still another important feature of the present invention is that the lever/fulcrum action of the hand tool, coupled with the friction created by the strap on the body, provides an accurate non-strenuous and easily controlled method of exerting pressure to various locations on the body. It is believed that the accuracy and amount of pressure exerted by the present invention, when used correctly, simulates most closely the hands, elbows, knuckles, etc. of a trained therapist; as well as the methods used by a trained therapist. Still another important feature of the present invention is the applicability thereof in practicing the well known Myotherapy Pain Relief Techniques.

The above-discussed features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGURES.

Figure 1:
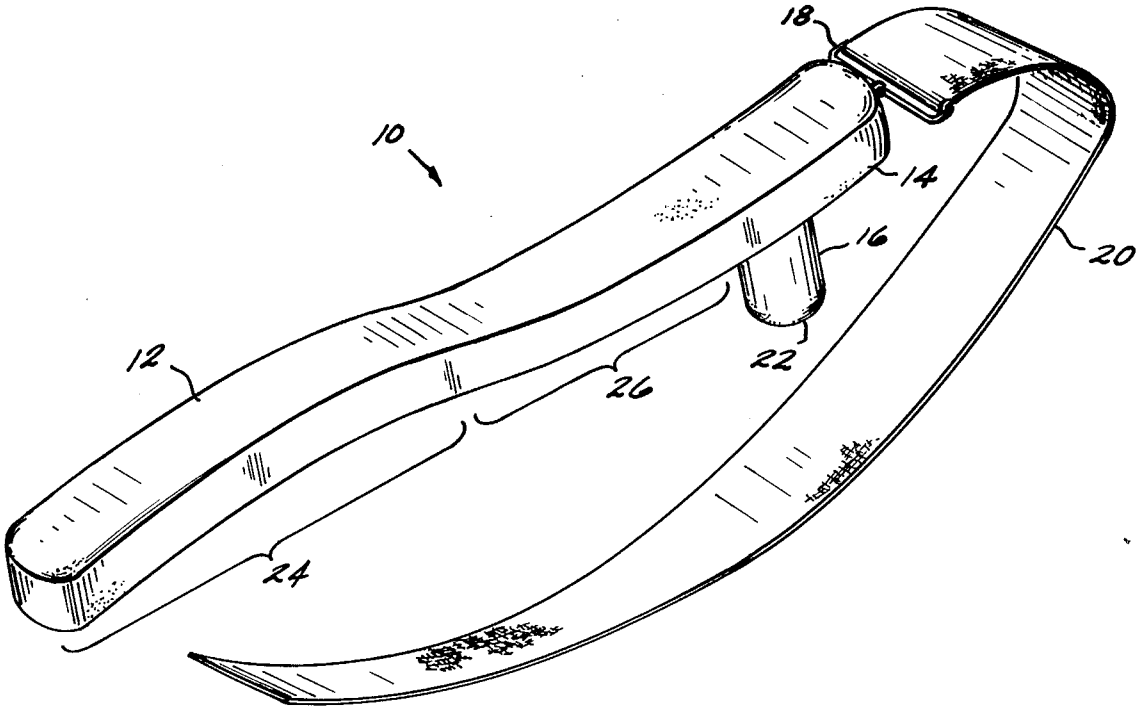
FIG. 1 is a perspective view of the pain therapy hand tool of the present invention.

DESCRIPTION OF THE PREFERRED EMBODIMENT:

Referring simultaneously to FIGS. 1–4, a pain therapy tool in accordance with the present invention is shown generally at 10. Pain therapy tool 10 comprises a slightly curved elongated handle 12 which terminates at a flattened section 14. Flattened section 14 includes a protrusion 16 extending substantially transversely from flattened section 14. The end of handle 12 nearest protrusion 16 includes an eye hook or the like 18 having a flexible strap 20 connected thereto such that strap 20 freely pivots with respect to eye hook 18 and handle 12.

Handle 12 is preferably about 14 inches long and $\frac{3}{4}$ inch thick. Handle 12 has a preferably spoon like shape in profile. Both tips of handle 12 are preferably rounded and slightly tapered. Protrusion 16 preferably protrudes about $2\frac{3}{4}$ inch from flattened section 14. The base 22 of protrusion 16 is slightly rounded. It will be appreciated that handle 12 and protrusion 16 may be comprised of any suitable material (e.g., wood or plastic) and may be manufactured as either a single piece or in a two piece configuration. In one preferred embodiment, handle 12 is comprised of a length of wood such as maple and protrusion 16 comprises a wooden dowel which is received in an opening drilled into handle 12.

While the FIGURES show strap 20 being pivotably connected to handle 12 by a threaded eye hook 18, it will be appreciated that any other method of pivotably attaching strap 20 to handle 12 may be used in conjunction with the present invention. It will be appreciated that in a preferred embodiment, eye hook 18 is coaxial with handle 12 and transverse to protrusion 16. Strap 20 may be comprised of fabric webbing of sufficient length (preferably at least 60 inches) and may be attached to eye hook 18 by being doubled back on itself and secured (e.g. sewn). Of course, any other attachment means may also be used.

Figure 2:
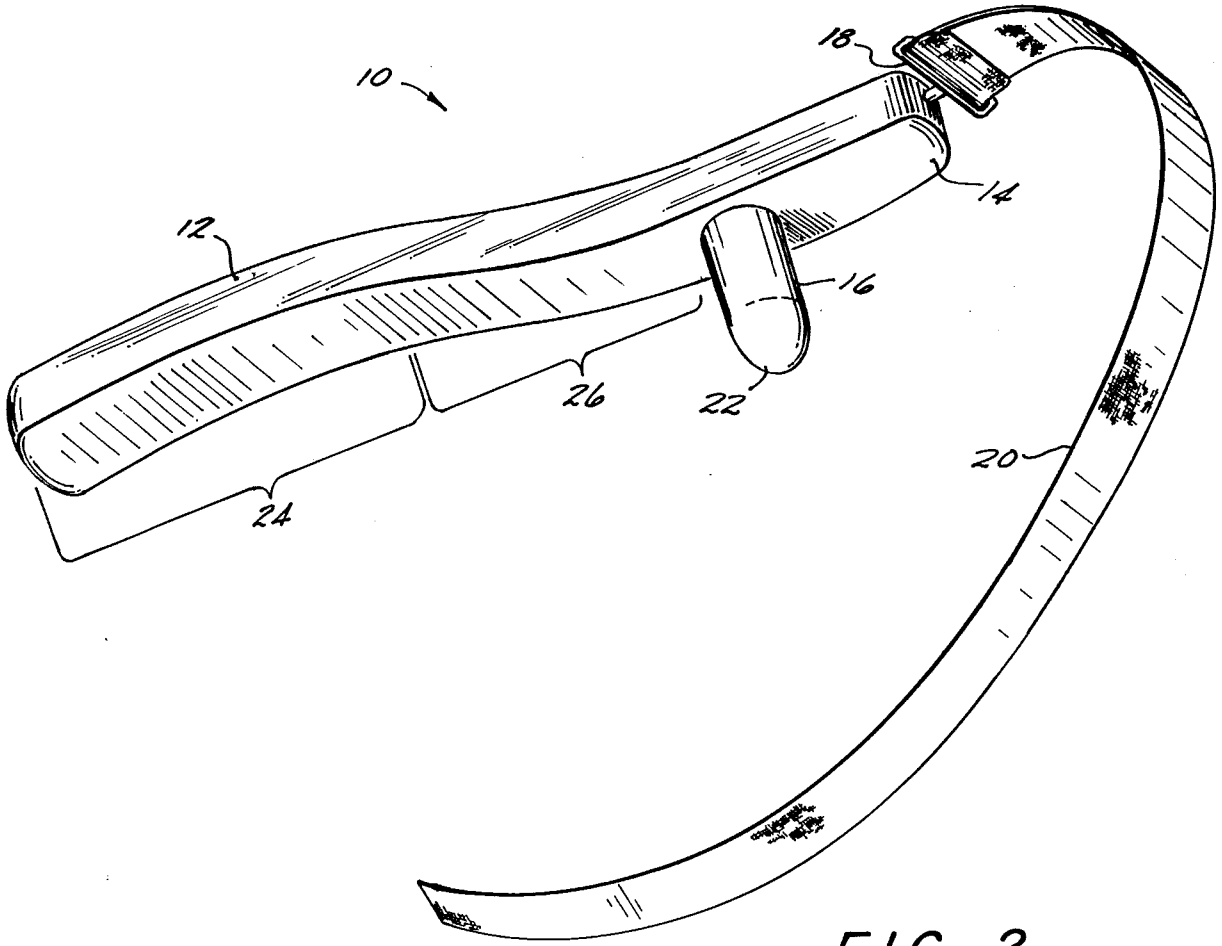
FIG. 2 is another perspective view of the pain therapy tool of FIG. 1.
Figure 3:
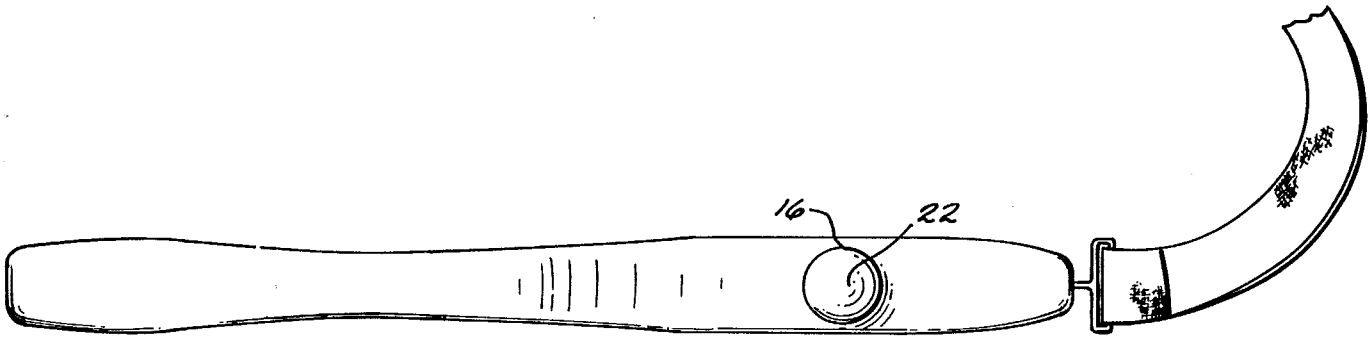
FIG. 3 is a bottom view f the pain therapy tool of FIG. 1.
Figure 4:
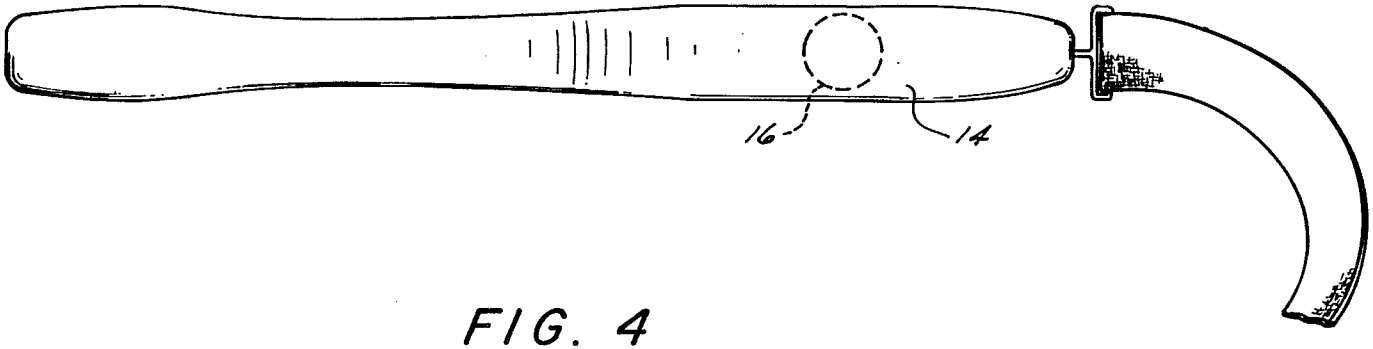
FIG. 4 is a top view of the pain therapy tool of FIG. 1.

As mentioned, handle 12 has a spoon shape in profile and includes a hand gripping section 24 and a curved transition section 26 which then terminates in flattened section 14 (see FIGS. 1 and 2).

Figure 5:
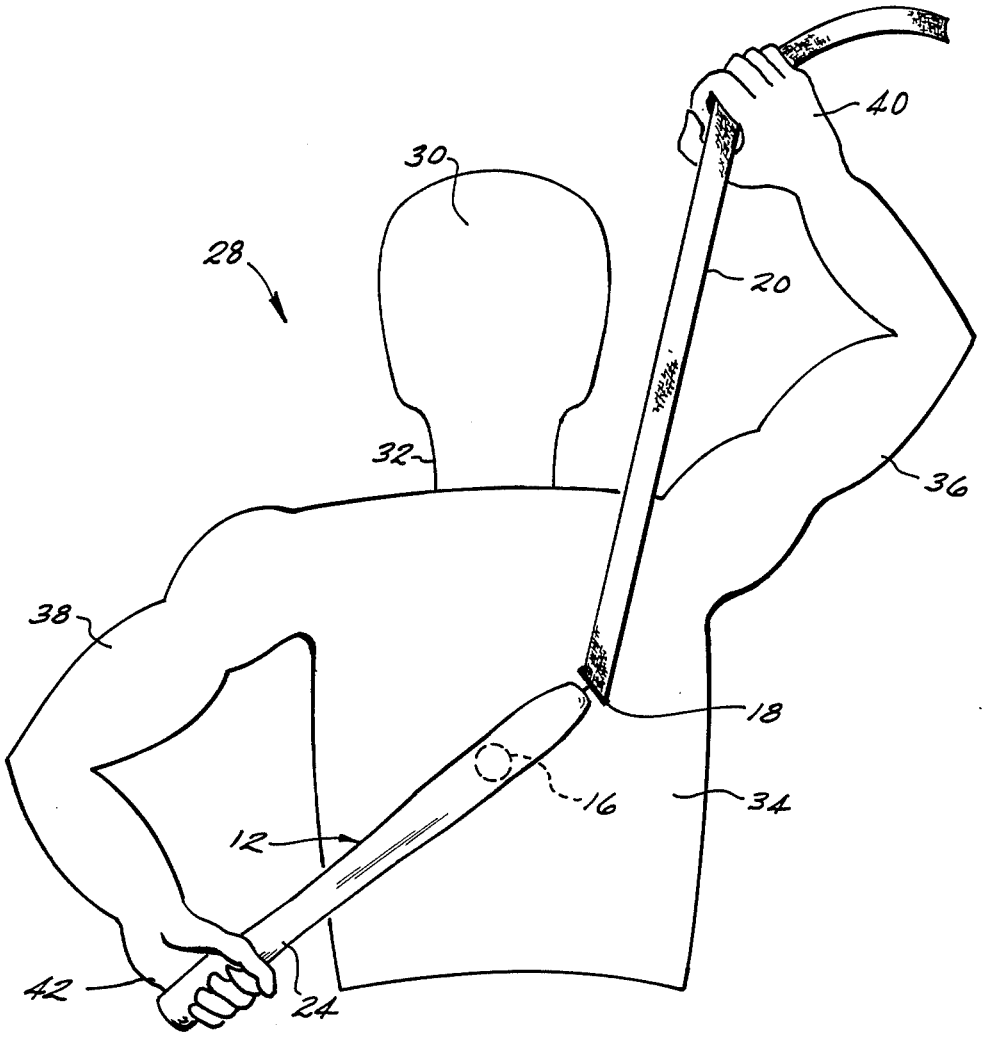
FIG. 5 is a diagrammatic view showing the pain therapy tool of FIG. 1 during operation on a persons' body.

Turning now to FIG. 5, a diagrammatic view is shown of pain therapy tool 10 of FIGS. 1–4 during actual use in pain therapy consisting of the deactivation or detriggering of trigger or pain points in the body. In FIG. 5, a caricature of the human body is shown generally at 28. Body 28 includes a head 30, neck 32, back 34, arms 36, 38 and hands 40 and 42. During use, the tool is orientated by use of the operator's hand 42 gripping handle 12 at the hand grip area 24 while the operator's other hand 40 grasps firmly onto a section of flexible strap 20 as is clearly shown in FIG. 5. Next, tool 10 is positioned such that the extended protrusion 16 is placed onto a preselected location on the body corresponding to a trigger or pain point. Tool 10 is then actuated by firmly holding strap 20 with hand 40, wrapped across the body to increase the stability and hold the tool securely, then pushing down onto handle 12 with hand 42. As a result, elongated handle 12 acts as a lever and the pivotal connection between handle 12 and strap 20 (eye hook 18) acts as a fulcrum forcing protrusion 16 into the body thereby exerting pressure at the preselected location corresponding to the trigger point. Of course, as much or as little pressure may be exerted simply by varying the amount of exertion on handle 24. It will be appreciated that strap 20 must be kept taunt during operation so that pivotal connection 18 will undergo its desired fulcrum function. All placements on the body are done through direct contact of protrusion 16 to the body by the participant feeling for the pain or trigger points.

While preferred embodiments have been shown and described, various modifications and substitutions may be made thereto without departing from the spirit and scope of the invention. Accordingly, it is to be understood that the present invention has been described y way of illustrations and not limitation.

What is claimed is:

1. Pain therapy tool for the human body comprising:

elongated unitary handle means having a pre-determined length and having a first end adapted for hand gripping and having an opposed second end, said handle means being rigid along the entirely of said pre-determined length, said first end of said handle means being free of any attachment to any other member;

said handle means including only a single rigid protrusion which is substantially transverse to said length of said elongated handle means, said transverse rigid protrusion extending outwardly from said handle means near said second end, said rigid protrusion being adapted to apply pressure to the human body at a specified single area on the body, said handle means being otherwise free of transverse protrusions; and flexible strap means having opposed first and second ends with said first end of said flexible strap means being pivotably connected to said second end of said handle means, and said second end of said strap means being free of any attachment to any other member.

2. The tool of claim 1 wherein:

said flexible strap means is pivotably connected to said handle means by hook means extending from said second end of said handle means.

3. The tool of claim 1 wherein:

said second end of said handle means includes a flattened section, said protrusion extending from said flattened section.

4. The tool of claim 3 wherein:

said handle means includes a curved transition section between said first end adapted for hand gripping and said flattened section.

5. The tool of claim 1 wherein:

protrusion terminates in a rounded configuration.

6. The tool of claim 1 wherein:

said protrusion terminates in a rounded configuration.

7. The tool of claim 1 wherein:

said elongated handle means and said protrusion are comprised of wood.

8. Pain therapy tool for the human body comprising:

elongated handle means having a first end adapted for hand gripping and having an opposed second end, said first end of said handle means being free of any attachment to any other member;

said handle means including only a single rigid protrusion which is substantially transverse to said length of said elongated handle means, said transverse rigid protrusion extending outwardly from said handle means near said second end, said rigid protrusion being adapted to apply pressure to the human body at a specified single area on the body, said handle means being otherwise free of transverse protrusions;

a single fulcrum point on said handle means, said fulcrum point being positioned at said second end of said handle means; and flexible strap means having opposed first and second ends with said first end of said flexible strap means being pivotably connected to said single fulcrum point, and said second end of said strap means being free of any attachment to any other member.

9. The tool of claim 8 wherein said fulcrum point comprises:

hook means extending from said second end of said handle means, said flexible strap means being pivotably connected to said hook means.

10. Trigger point pain therapy tool for the human body comprising:

elongated handle means having a pre-determined length and having a first end adapted for hand gripping and having an opposed second end, said first end of said handle means being free of any attachment to any other member;

only a single rigid protrusion extending laterally and outwardly from said handle means near said second end with said handle means being otherwise free of lateral protrusions, said rigid protrusion being adapted to apply pressure to the human body at a specified single area on the body, said single protrusion being substantially transverse to said length of said elongated handle means; and flexible strap means having opposed first and second ends with said first end of said flexible strap means being pivotably connected to said second end of said handle means, and said second end of said strap means being free of any attachment to any other member.

11. The tool of claim 10 wherein:

said flexible strap means is pivotably connected to said handle means by hook means extending from said second end of said handle means.

12. A method of trigger point pain therapy on a body using a trigger point pain therapy tool comprising elongated rigid handle means having a pre-determined length and having a first end adapted for hand gripping and having an opposed second end, with only a single rigid protrusion extending outwardly from said handle means near said second end, which is substantially transverse to said length of said elongated handle means, said handle means being otherwise free of transverse protrusions, said rigid protrusion being adapted to apply pressure to the human body at a specified single area on the body and a flexible strap pivotably connected to said handle means at a fulcrum point at said second end thereof, including the steps of:

manually gripping said first end of said handle means and positioning said protrusion onto a single trigger point on the body;

manually gripping said flexible strap and frictionally engaging said flexible strap to the body; and pulling said handle means so that said single protrusion exerts pressure on the single trigger point and said flexible strap pivots about said fulcrum point.

* * * * *